United States Patent [19]

Nixon

[11] Patent Number: 4,616,553

[45] Date of Patent: Oct. 14, 1986

[54] FAST-MOVING EYELET GUIDE FOR A GROUP OF BRAIDABLE STRANDS IN A BRAIDING MACHINE

[76] Inventor: Charles E. Nixon, 224 Edwards Ave., Sayville, N.Y. 11782

[21] Appl. No.: 698,811

[22] Filed: Feb. 6, 1985

[51] Int. Cl.[4] ..... D04C 3/18; D04C 3/06; D04C 3/42

[52] U.S. Cl. ..... 87/48; 87/21; 87/49; 87/55; 87/57; 242/157.1

[58] Field of Search ..... 87/20–22, 87/48, 49, 54–57, 62, 61; 242/157.1

[56] References Cited

U.S. PATENT DOCUMENTS

| | | | |
|---|---|---|---|
| 949,823 | 2/1910 | Faire | 87/55 |
| 1,387,300 | 8/1921 | Oliver et al. | 242/157.1 |
| 1,689,389 | 10/1928 | Horn | 87/48 |
| 2,464,899 | 3/1949 | Sokol | 87/48 |
| 4,130,046 | 12/1978 | Sokol | 87/48 |

*Primary Examiner*—John Petrakes
*Attorney, Agent, or Firm*—Parmelee, Bollinger & Bramblett

[57] ABSTRACT

Fast-moving eyelet guide for use on a braiding machine, such as a Wardwell braiding machine having a lower carrier mounting track with a plurality of carriers movable along the track. Each carrier holds a spool of strands with a guide clamped onto the carrier. The guide includes a pair of spaced parallel guide rods with a very lightweight spool-shaped eyelet mounted for free movement up and down while remaining captured between these parallel rods. The strands are threaded through and carried by the eyelet, and thus the strands are controlled by the eyelet and are kept closely together as a controlled group during their up and down movement along the parallel guide rods which avoids separation of the strands, thereby dramatically limiting the incidence of breakage of the strands. The invention is particularly useful in any braiding machine in which multiple strands or filaments are being payed off from each spool and the multiple strands are not twisted together and can easily become separated from each other, because the fast-moving eyelet holds these individual strands in a compact group less than one inch from the stationary deflector cam components of the braiding machine. Thus, the strands cannot easily separate from each other so as to snag and break.

9 Claims, 5 Drawing Figures

Fig. 2.
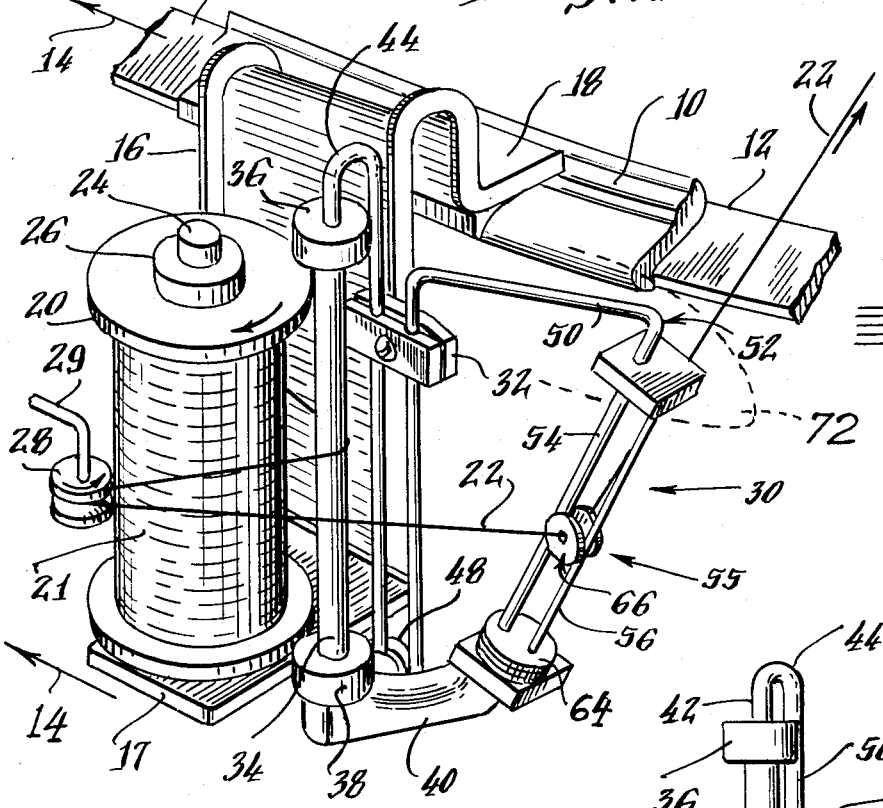
Fig. 1.
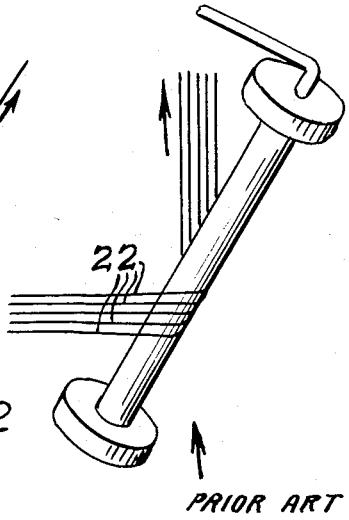
Fig. 3.
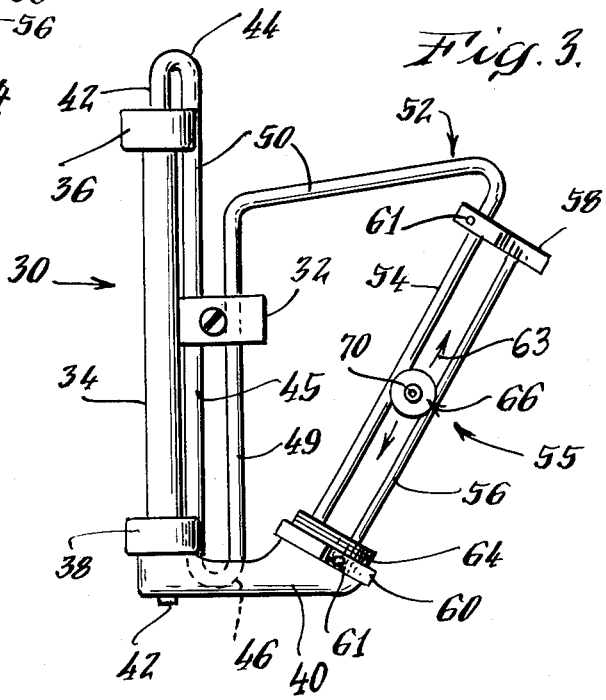
Fig. 4.
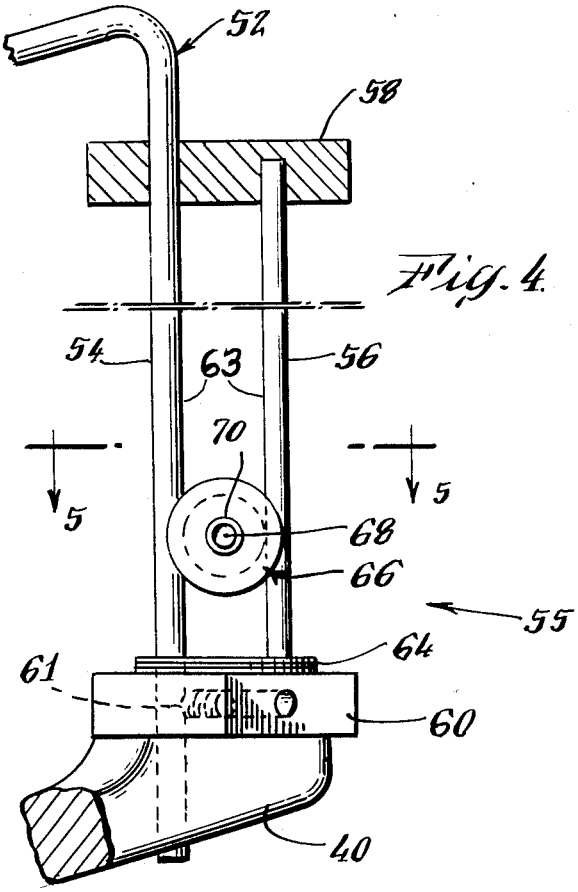
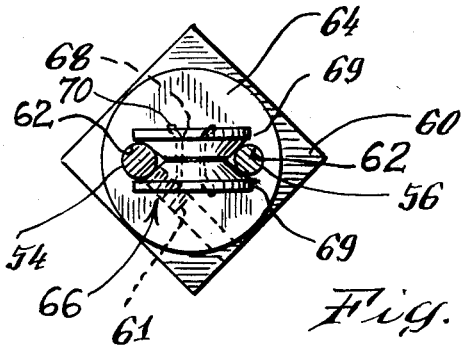
Fig. 5.

FAST-MOVING EYELET GUIDE FOR A GROUP OF BRAIDABLE STRANDS IN A BRAIDING MACHINE

BACKGROUND OF THE INVENTION

This invention relates to braiding machines and more particularly to a fast-moving eyelet guide for use in such machines in which multiple strands or filaments are being simultaneously payed off from each spool, these multiple strands not being twisted together.

Braiding machines, for example, the Wardwell braiders, have been used commercially for many years, probably for at least sixty years, and can be used to apply a braid layer of wire strands around an electrical cable for protecting the inner conductors of the cable, for shielding the cable, and often for providing a grounded outer conductive sheath for the cable. Such braiding machines are also used to form a braid or to form a braid layer around a core, for example to braid glass strands around an electrical conductor.

The Wardwell braiding machine normally includes an upper and a lower revolving carriage each of which contains a plurality of supply spools of strands, for example eight upper spools and eight lower spools. The strands from all of these spools are fed together for forming the braided layer around the electrical cable.

All of the upper and lower spools contain the same number of strands. For example, in the braiding of wire strands around an electrical conductor in the prior art, each spool contains a number of wire strands in the range from 3 to 9.

The wire strands from the respective upper and lower supply spools are interweaved by the machine to form the braiding around the cable. Since the clusters of wire strands are unwound from the respective individual supply spools, guide apparatus must be provided for each spool in order to align and feed the cluster of wire strands together at the proper direction for producing the interweaving braiding action.

FIG. 1 illustrates a prior art inclined wire strand guide roll as associated with each of the lower supply spools in a conventional Wardwell braiding machine. The cluster of wire strands 22 from the spool travels up and down along this guide roll. This high speed movement unpredictably allows the individual unrestrained strands to become separated from each other, as will be understood from FIG. 1. The individual strands respond to their individual tensions and to their individual friction effects, thus allowing them to become spread apart irregularly as they proceed to be subsequently moved by horizontal guide cam components in the braiding machine. The strand or strands which separate from their neighbors are vulnerable to snagging or missing the upward and downward transpositions required by the horizontal guides in the braiding machine, which unpredictably causes one or more of the strands to break quite often. Such frequent breakage considerably slows the braiding process, makes it expensive and prevents the production of a long braided product. A coaxial cable product must be cut to length whenever a broken strand occurs, because the coaxial cable should not have a braid layer containing broken strands. I have found that using the prior art wire guide apparatus illustrated in FIG. 1 on a Wardwell braider causes a wire strand or several strands to break on an average of every few hours or so, and usually more than one strand breaks at the same time.

SUMMARY OF THE INVENTION

It is an object of this invention to provide improved strand guide apparatus in a braiding machine which permits high speed movement of the cluster of strands along the wire guide, while producing an astonishing improvement in reducing the occurrence of strand breakage.

Among the many advantages of this invention is the economy realized by being able to run the braiders for protracted periods of time without a breakage occurring and by avoiding the loss of machine time, and in the case of costly products such as microwave cable, by avoiding the undesired creation of costly scrap.

A further object of this invention is to provide a new and novel improved wire guide apparatus which permits more economical cable production, because of far less breakage and far fewer shutdowns than occur when employing prior art wire guiding apparatus on a Wardwell braiding machine.

Another advantage to be noted is the ability to profitably produce long lengths of coaxial cable by running multiple wire strands through a small, light-weight rapidly movable eyelet to avoid the need (or common practice) for submerging the bobbins (spools) containing braid wires in oil to reduce breakage. This common expedient of oiling the wire strands introduces a contaminant (the oil) into the resulting wire braid electrical shield, which is detrimental to the performance of a coaxial cable. The presence of such oil is particularly detrimental at higher frequencies and is extremely so in the gigaHertz frequency range.

In carrying out this invention in one illustrative embodiment thereof, multiple strand guide apparatus is provided for use on a braiding machine which has a lower carrier mounting track with carriers movable thereon, each of which carries a spool of strands and has multiple strand guide means clamped onto the carrier. The improved multiple strand guide means comprises an upright guide roll mounted on a bracket member having the strands being fed therearound from the spool and then led around a grooved roller. The guide means include an elongated track with a very light weight eyelet mounted for fast movement along the track, this eyelet being free to move along the track in either direction. The multiple strands are led through this eyelet, while it is free to move up and down along the track, whereby the cluster of strands is controlled by the eyelet and is held together in its very rapid movement up and down during the braiding operation, thereby dramatically reducing and limiting the incidence of breakage of the strands in the braiding process.

Advantageously, the fast-moving eyelet carrying the multiple strands permits rapid up and down movement of the strands as a group and keeps them under control, being held together in a close group as the strands go into the braider, thereby avoiding the unpredictable behavior of individual strands and variable sliding action of the multiple strands on the horizontal guide cams, such as occurs when using the angled prior art guide roll of FIG. 1. The present invention provides an improvement of the order of three times or more with respect to the reduction in the amount of breakage as compared with the prior art apparatus as described, when braiding multiple groups of multiple wire strands.

BRIEF DESCRIPTION OF THE DRAWINGS

The invention, together with further objects, advantages, aspects, and features thereof will be more clearly understood from a consideration of the following description taken in conjunction with the accompanying drawings, in which:

FIG. 1 is a perspective view of an angled wire guide roll with its mounting brackets which is employed in the prior art, such roll often allows the multiple untwisted strands to become separated from one another as illustrated, as I have determined from careful analysis. Such strand separation is not visible nor detectable during running of a braiding machine at normal speeds of operation, but my analysis has convinced me that strand separation often occurs.

FIG. 2 is a perspective view of a portion of a lower carrier track of a Wardwell braiding machine with a carrier movable along this track and employing the improved guide apparatus embodying the present invention.

FIG. 3 is a front elevational view of the improved wire guide apparatus shown in FIG. 2.

FIG. 4 is an enlarged view of the right hand side of FIG. 3, which illustrates the operation of the guide means shown in FIG. 3.

FIG. 5 is a cross sectional view taken along line 5—5 of FIG. 4 looking down toward the movable multiple strand guiding eyelet.

DESCRIPTION OF THE PREFERRED EMBODIMENT

Referring now to FIG. 2, a lower spool carrier 10 is movable along a lower carrier mounting track 12 of a Wardwell braiding machine as made by the Wardwell Braiding Machine Corporation of Providence, Rhode Island. During the braiding operation this lower carrier 10 revolves in a counterclockwise direction along the track 12 as indicated by the arrow 14. This track supports a plurality of identical lower spool carriers 10, for example eight of them, but only one of the lower carriers is shown for clarity of illustration. There is also an upper revolving carriage (not shown) which revolves in the opposite (clockwise) direction. The upper revolving carriage supports an equal number of upper spools, for example eight upper spools. The number of upper and lower spools is the same. This number is not critical, but usually is an even number.

An upwardly arching mounting bracket 16 has a base 17 and is attached at its upper end 18 to the lower carrier 10. The bracket 16 carries a supply spool 20 containing a winding 21 of a cluster or group 22 of multiple untwisted strands which are all simultaneously being payed off from the same spool 20. In this example the multiple strands 22 are wire strands for applying a braided layer of wire strands around an electrical conductor, but it is to be understood that other types of untwisted multiple strands can be advantageously guided in a braiding machine by the present apparatus. This spool 20 is mounted on a spool shaft 24 secured to the base 17 and having a spool bearing 26 thereon. The bracket 16 also carries a grooved pulley roller 28 which has a spring-biased, movable tension lever 29 attached thereto for applying yieldable tension force to the wire strands 22 which travel around this grooved pulley. These wire strands are quite fine, and they advantageously remain in a close cluster or group 22 as they pass through the eyelet guide as seen in FIG. 2.

One of the problems of the prior art inclined guide roll of FIG. 1 is that it allows varying behavior of the individual strands and allows them to spread, separate, or fan out, as illustrated by the spread apart strands 22, thereby making the individual separated strands vulnerable to catching upon and becoming broken by the cam components which alternately deflect the whole group of strands upwardly and downwardly for producing the braid. Nevertheless, for decades the prior art has existed without change as shown in FIG. 1.

This spreading apart of the multiple untwisted strands 22 is not visable nor detectable during running of a braiding machine at normal operating speeds. My analysis has convinced me that strand separation often occurs and usually is the cause of breakage. Regardless of whether this analysis is correct or not, the employment of this invention on a wire braiding machine actually reduces the occurrence of strand breakage, thus saving considerable operating cost and "downtime". The improvement is greatest in the case of nickel-coated wire strands, which apparently exhibit variable friction effects. The improvement is less in the case of silver-coated wire, because they have exhibited a lesser tendency to become snagged and broken, apparently because silver-coating is more consistent in frictional effects, but economically the improvement is most important in the case of silver-coated wires, for they are used to make more expensive products wherein scrappage is most costly. It is likely that similar improvements will be obtained by using this improved multiple strand guide apparatus on a braiding machine for braiding other types of untwisted strands than wire strands.

The group 22 may include any number of strands conventionally used, depending upon the diameter of the cable around which the wire strands are being braided.

Improved multiple strand guide apparatus, referred to generally with the reference 30, is clamped by a clamp 32 to the bracket 16. The improved guide apparatus 30 includes a conventional upright guide roll 34 having upper and lower spool flanges 36 and 38 thereon which serve as end limits to prevent the wire strands 22 which are lead from the spool 20 around the upright guide roll 34 from moving off this guide roll 34. The upright guide roll 34 is mounted on a support member 40 by a first leg 42 (FIG. 3) of a narrow U-shaped bend 44 formed in a shaped wire rod 50. The wire rod 50 may be continuous and be shaped in a first narrow U-shaped bend 46 which is secured at the U-bend portion thereof by a screw 48 (see FIG. 2) to the member 40. There is a third leg 49 of the wire rod 50 extending up from the U-bend 46, and the continuation of this wire rod is shaped into a triangle 52, with the inclined leg 54 thereof terminating in and being secured in the member 40. By forming the continuous wire rod 50 into the U-bends 44, 46 and the triangular shaped loop 52, the entire wire guide apparatus 30 may be clamped and suspended by the single clamp 32 from the bracket 16 on the carrier 10.

Up to this point the wire guide apparatus 30 which has been described is conventional except for the eyelet which has been mentioned. Accordingly, a detailed description of the braiding machine and its operation will not be set forth here, as it does not constitute a part of the present invention.

The present improvement resides in the multiple strand guide apparatus 30, and more specifically in the angled guide means 55 which is a portion of the guide apparatus 30. This improved guide means 55 includes the leg 54 of the triangular loop 52 formed by the wire rod 50. This leg 54 now serves as a first guide rod of an elongated guide track 63. The angled wire guide means 55 includes a second guide rod 56 of the guide track 63. This rod 56 is parallel to and spaced from the first guide rod 54. The spaced, parallel guide rods 54 and 56 are joined by top and bottom members 58 and 60 respectively, with a bottom bumper 64 of impact-absorbent resilient material, for example an assembly of several thin layers of rubber and fabric. The top and bottom track members 58 and 60 are secured and positioned by set screws 61 engaging the first guide rod 54, and the bumper 64 has a pair of holes 62 which snuggly receive the respective guide rods 54, 56.

The pair of spaced, parallel guide rods 54 and 56 form the elongated track 63 therebetween which is limited in its extent by the top member 58 and by the bottom member 60 and bumper 64. A very light weight fast-moving spool-shaped eyelet 66 with an eyelet opening 68 therein is mounted between these guide rods for free up and down slidable and rolling movement in the track formed by the pair of spaced parallel rods 54 and 56. The fast-moving eyelet 66 has a pair of outwardly sloping flanges 69 (FIG. 5) forming a V-shaped groove between these flanges. For example, the inner surface of each flange 60 slopes outwardly at an angle of 45°, thereby forming a 90° V-shaped groove for freely engaging the guide rods 54 and 56. This spool-shaped eyelet is preferably made of rigid, slippery low-friction plastic, for example of Nylin or Delrin, and it has a very small amount of mass, for it weighs only approximately 0.023 of an ounce. It has a central bushing 70 defining the eyelet opening 68. This opening is smoothly rounded and has a rounded funnel-shaped entry and exit for freely and easily allowing the group of wire strands 22 to pass through it. The bushing 70 is made of hardened steel, bronze or industrial ceramic intended for wear resistant applications, for example "Heanium" ceramic obtainable commercially from Heany Industries, Incorporated of Scottsville, New York. It is to be noted that all of the corners in the opening 68 are smoothly rounded. The wire strands 22 are threaded through this opening 68, and the round funnel-shaped entry and exit minimize the friction occurring between the wire strands 22 and the spool-shaped eyelet 66. It is desirable to make the eyelets 66 as small in mass as possible for minimizing their inertial effects as the speed of the braiding machine is increased.

Advantageously, as indicated above, the eyelet opening 68 freely holds all of the individual wire strands close together in a cluster or bundle. Even though the eyelet 66 travels very rapidly up and down along the track 54, 56 during a braiding operation, the wire strands 22 are caused to remain close together. Therefore, individual strands cannot become separated from the others and consequently the incidence of snagging and breakage is dramatically reduced.

It is to be understood that in a braiding machine there are stationary horizontal cam components one of which is partially indicated in dashed outline at 72, which deflect the multiple strands 22 up over other multiple strands coming from respective upper spools revolving in the opposite direction. Then, cam components deflect the strands 22 down under other upper strands, and so forth as the braiding operation proceeds. This alternate upward and downward deflection occurs at high speed during running of the braiding machine; the gaps between the respective upward and downward acting cam components are relatively small; and all of the strands 22 must pass through each gap essentially at once. In accordance with my analysis, if the strands 22 spread apart in their travel along the respective upward and downward acting cam components, one or more of them may not make the quick move all at once through the gap. Consequently, one or more strands become snagged and broken.

It is to be understood that this movable eyelet 66 during its up and down movement passes less than one inch from the stationary deflector cam components 72 of the braiding machine. Consequently, this eyelet 66 controls the strands keeping them in a compact group near to the cam components 72.

Advantageously, the eyelet 66 holds the strands 22 all closely together in a unified group as illustrated in FIG. 2 and also beneficially tends to hold them together as a compact group when they quickly move down or up through a gap in the respective deflector cam components 72 of the braiding machine. Thereby, the guide means 55 improves the uniformity and consistency of the braiding lay, dramatically reducing the incidence of strand breakage.

Moreover, the strands 22 themselves are isolated from rapid up-and-down sliding friction effects, because the eyelet 66 itself does the up and down sliding movement along the track 54, 56. Thus, the wire strands are now only subjected to minimal longitudinal friction as they freely slide through the smooth opening 68 in the bushing 70. By virtue of the very small mass of this spool-shaped eyelet, the acceleration forces are miniscule as it is rapidly accelerated up and down along the track 63, and thus its acceleration imposes insignificant loading on the strands 22.

In operation the wire strands from the winding 21 on the spool 20 move around the upright guide roll 34, then around the grooved roller 28 and finally through the opening 68 of the spool-shaped eyelet 66. As the wire strands 22 are being payed out during a braiding operation the spool-shaped eyelet 66 moves freely up and down at a high rate of speed in the track 63 formed by the two guide rods 54 and 56 as the closely guided but untwisted strands 22 are alternatively deflected upwardly and downwardly by the cam components 72 of the braiding machine for interweaving the strands 22 over-and-under the groups of strands (not shown) from the upper spools (not shown) for forming the uniform, consistent braid sheath around electric cable. The various beneficial results and advantages of this invention are described above at several places and therefore do not need to be repeated here.

As used herein the term "untwisted" as applied to the multiple strands 22 means that these strands are laying reasonably parallel to each other as a group of individuals, without being intentionally wrapped around each other in a helical lay to form them together into one uniform string.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as defined in the following claims.

What I claim is:

1. For use in a multiple untwisted strand braiding machine having a movable carrier for carrying a spool of multiple untwisted strands in which the multiple strands are fed from the spool containing a winding of such multiple strands mounted upon the movable carrier, and after unwinding from the spool the multiple untwisted strands are deflected by stationary horizontal cam components for deflecting said multiple strands upwardly and downwardly, multiple untwisted strand guide apparatus comprising:

track means mounted on said movable carrier defining an elongated guide track extending upwardly and downwardly, a very lightweight eyelet having an overall weight less than one-tenth of an ounce mounted in said elongated guide track and being freely movable along said guide track, said eyelet having a smoothly rounded opening therethrough with smoothly rounded entry and exit, said opening being adapted to have said multiple strands fed through it for allowing free upwardly and downwardly movement of said eyelet along said track means, and said eyelet being spaced less than one inch from the nearest of said stationary horizontal cam components of the braiding machine in at least one position of the upward and downward movement of the eyelet for retaining said multiple untwisted strands grouped compactly with each other at said position less than one inch from the nearest of said stationary horizontal cam components, whereby said multiple strands are protected from individual friction effects in their collective upward and downward movement and whereby said strands are retained closely grouped together by said eyelet near to said stationary horizontal cam components, thereby greatly reducing the incidence of breakage of said strands during operation of the braiding machine.

2. The multiple strand guide apparatus for use in a braiding machine as set forth in claim 1, in which:

said eyelet is made of rigid, slippery low-friction material with the eyelet opening therein having a smooth, wear resistant lining.

3. The multiple strand guide apparatus for use in a braiding machine as set forth in claim 1, in which:

said track means defines an elongated track having an elongated opening between a pair of upright spaced parallel guide members, and said eyelet is a spool-shaped eyelet captured between said parallel members and free to move up and down along them.

4. The multiple strand guide apparatus for use in a braiding machine as set forth in claim 3, in which:

said pair of spaced parallel guide members have upper and lower support members with an impact-absorbent resilient bumper which limits the down movement of said spool-shaped eyelet.

5. The multiple strand guide apparatus for use in a braiding machine as set forth in claim 4, in which:

said parallel guide members are a pair of rods, and said resilient bumper includes a plurality of layers of resilient, impace-absorbent material having a pair of openings snuggly fitting around said rods for retaining said layers in operating position at the lower end of said elongated track.

6. The multiple strand guide apparatus for use in a braiding machine as set forth in claim 3, in which:

said parallel guide members are round rods, and said spool-shaped eyelet has a pair of flanges each having an outwardly sloping inner surface defining a V-shaped peripheral groove extending around said eyelet capturing said spool-shaped eyelet between said round parallel guide rods while allowing free travelling high speed movement of said very lightweight eyelet along said parallel guide rods.

7. The multiple strand guide apparatus for use in a braiding machine as set forth in claim 1, in which:

said opening in said eyelet is lined with smooth, hard, wear-resistant material and is adapted for freely passing a group of wire strands.

8. In a braiding machine, such as a Wardwell braider and the like, in which multiple untwisted strands are fed from each of a plurality of lower spools supported by moving mounting means upon a movable lower carrier and stationary deflector cam components serve to deflect the multiple untwisted strands during braiding action, apparatus for reducing the incidence of breakage of the strands in the braiding machine comprising:

a plurality of movable lightweight eyelet guides, respective ones of said eyelet guides being movably mounted near the respective lower spools and having the multiple untwisted strands passing through the eyelet guide and being positioned near said deflector cams, said movable eyelet guides moving to within less than one inch from the nearest deflector cams for controlling the multiple strands being fed from each respective spool for keeping the multiple untwisted strands from the respective spool closely compactly associated near said deflector cams for reducing the incidence of snagging and breakage of individual strands.

9. In a braiding machine, apparatus for reducing the incidence of strand breakage as claimed in claim 8, in which:

said lightweight eyelet guides have a wear-resistant opening through which the multiple strands are passed, and elongated track means carry each eyelet guide for enabling the eyelet guide to move freely up and down along said track means.

* * * * *